US009902543B2

(12) United States Patent
Macler

(10) Patent No.: US 9,902,543 B2
(45) Date of Patent: Feb. 27, 2018

(54) SYSTEMS AND METHODS OF PROVIDING SANITARY WATER IN A DISASTER OR SIMILAR SITUATION

(75) Inventor: Jeffrey E. Macler, Tecumseh, MO (US)

(73) Assignee: INTERNATIONAL PACKAGING INNOVATIONS, LLC, St. Louis, MO (US)

( * ) Notice: Subject to any disclaimer, the term of this patent is extended or adjusted under 35 U.S.C. 154(b) by 2365 days.

(21) Appl. No.: 12/533,914

(22) Filed: Jul. 31, 2009

(65) Prior Publication Data

US 2010/0193542 A1 Aug. 5, 2010

Related U.S. Application Data

(60) Provisional application No. 61/085,234, filed on Jul. 31, 2008, provisional application No. 61/092,536, filed on Aug. 28, 2008, provisional application No. 61/095,459, filed on Sep. 9, 2008.

(51) Int. Cl.
*B67D 7/06* (2010.01)
*B65D 75/58* (2006.01)

(52) U.S. Cl.
CPC ..... *B65D 75/5877* (2013.01)

(58) Field of Classification Search
CPC ..... B65D 75/5877
USPC ..... 222/81, 88, 92, 107, 541.1, 541.2, 1
See application file for complete search history.

(56) References Cited

U.S. PATENT DOCUMENTS

| | | | | |
|---|---|---|---|---|
| 3,792,799 | A * | 2/1974 | Henfrey | 222/1 |
| 4,314,654 | A * | 2/1982 | Gaubert | 222/83 |
| 4,640,425 | A * | 2/1987 | Cabernoch | 215/11.6 |
| 5,102,010 | A * | 4/1992 | Osgar et al. | 222/1 |
| 6,082,584 | A * | 7/2000 | Stern | 222/83 |
| 7,011,233 | B2 * | 3/2006 | Drennow | 222/105 |
| 8,348,104 | B2 * | 1/2013 | Py et al. | 222/214 |
| 2008/0142543 | A1 | 6/2008 | Jones | |

* cited by examiner

*Primary Examiner* — J. Casimer Jacyna
(74) *Attorney, Agent, or Firm* — Lewis Rice LLC

(57) ABSTRACT

A system and method for dispensing potable fluids wherein a bagged fluid, such as water, is dispensed via a spiked water dispensing device.

17 Claims, 10 Drawing Sheets

SYSTEMS AND METHODS OF PROVIDING SANITARY WATER IN A DISASTER OR SIMILAR SITUATION

CROSS REFERENCE TO RELATED ED APPLICATION(S)

This application claims benefit of U.S. Provisional Patent Applications Ser. Nos. 61/085,234, 61/092,536, and 61/095,459 filed Jul. 31, 2008, Aug. 28, 2008, and Sep. 9, 2008, respectively, the entire disclosures of which are herein incorporated by reference.

BACKGROUND

1. Field of the Invention

The present disclosure generally relates to the field of sanitary systems for dispensing of fluids. In particular, to the field of fluid dispensing systems wherein a bagged fluid, such as water, is dispensed via a spiked water dispensing device.

2. Description of the Related Art

Water is necessary for all life on earth. While humans can survive for several weeks without food, they can not survive for more than a few days (somewhere around five, depending on the temperature and humidity of the surrounding environment) without water. In fact, humans need a constant supply of water in order to replenish the fluids lost through normal physiological activities, such as respiration, sweating and urination. As it is involved in a number of different biological processes, water is essential for the growth and maintenance of the human body.

Potable water, or drinking water, is water that is fit for consumption for humans or animals. Although over seventy percent (70%) of the Earth's surface is covered in water, not all of this water is fit for human consumption. While oceans are sometimes mistaken for available water, the amount of energy needed to convert saline water to potable water is prohibitive, which explains why only a small portion of the world's water supply is derived from desalination. Of all the Earth's renewable resources, fresh water may well be the most unforgiving: difficult to purify, expensive to transport and impossible to substitute. Lack of potable water, albeit by lack of access to potable water, lack of water resources, or contamination, is historically one of the largest causes of human morbidity. Due to rising populations and the alleviation of poverty in quasi-developing countries, among other factors, the "resource crunch" on potable water will only increase in the future.

One of the main reasons for poor access to potable water is the inability to finance and to adequately maintain the necessary infrastructure. Overpopulation and scarcity of water resources are also contributing factors.

Access to potable water is a significant issue in the developing world. As water supply and sanitation require a huge amount of capital investment in infrastructure, such as pipe networks, pumping stations and water treatment works, it is estimated that developing nations will need to invest at least two hundred (200) billion U.S. dollars per year to replace aging water infrastructure systems, establish water infrastructure systems, reduce leakage rates, and protect water quality. This capital intensive nature of starting and maintaining a sanitary water supply to a population restricts access to this technology and leaves many in the developing world without a reliable potable water source.

Currently, in rural communities, individuals will generally walk around one (1) to three (3) miles daily to access the public potable water source, carrying heavy containers on their heads generally totaling around five (5) to eight (8) gallons per trip. Should there be contamination at the public water source; the whole community could be put at risk.

Potable water can be accessed from a number of natural sources. These sources include: ground sources (e.g., aquifers, aquitards, etc.); water from the sky (also called storm water, this includes rain, hail, snow and fog); surface water (e.g., streams, rivers, lakes, etc.); among other sources such as plants and animals. While fresh water is a renewable resource, the world's supply of clean, fresh water is steadily decreasing. The demand for potable water already exceeds supply in many parts of the world, and as the world's population continues to rise at an unprecedented rate and a larger portion of the world's population joins the middle class, many more areas are expected to experience this imbalance.

In recognition of the rising population's demand for potable water exceeding the available supply, the United Nations and other world-wide political and philanthropic organizations have coined the term "water crisis." The two major factors of the water crisis are the overall scarcity of useable water, combined with pollution of existing potable water sources.

While the world's population tripled in the $20^{th}$ century, the use of renewable water resources has grown six-fold. Within the next fifty years, the world population will increase by another forty percent (40%) to fifty percent (50%). This population growth, coupled with industrialization and urbanization, will result in an increasing demand for water and will have serious consequences.

The water crisis will only get worse in the coming decades as the world's population grows and a greater percentage of that population joins the middle class. Historically, as a country's economy becomes stronger; i.e., as its GNP per capita rises, a larger percentage of its people tend to have access to drinking water and sanitation. Access to drinking water is generally measured by the number of people who have a reasonable means of getting an adequate amount of water that is safe for drinking, washing, and essential to household activities. Accordingly, as the two populous countries of China and India alleviate poverty, paving the way for more of their populations to enter the middle class, these countries will also have a higher water consumption: from demanding fresh water twenty four (24) hours a day, seven (7) days a week and basic sanitation service, to demanding water for gardens and car washing, to wanting Jacuzzis or private swimming pools.

Taking the above together, it has been projected that North Africa, the Middle East, South Africa and Northern China will face a very severe water shortage due to physical scarcity and a condition of overpopulation relative to their carrying capacity with respect to water supply. In addition, it has been projected that most of South America, Sub-Saharan Africa, Southern China and India will face water supply shortages by 2025. For these later regions however, the causes of scarcity will be economic constraints to developing safe drinking water, as well as excessive population growth.

As to contamination, waterborne diseases, which cause a large number of deaths, are caused by pathogenic microorganisms in water which are directly transmitted to a host when contaminated drinking water is consumed. While the occurrence of waterborne diseases in developed countries is generally low due to a good system of water treatment, distribution and monitoring; waterborne diseases are among the leading cause of morbidity in low and middle income countries, commonly referred to as developing countries. According to the World Health Organization, diarrheal disease accounts for an estimated four point one percent (4.1%) of the total global burden of disease and is responsible for the deaths of one point eight (1.8) million people every year. It is estimated that eighty eight percent (88%) of that burden is attributable to unsafe water supply, sanitation, and hygiene; and is mostly concentrated in children in developing countries.

While many pollutants threaten water supplies, the most widespread, especially in underdeveloped countries, is the discharge of raw sewage into natural waters. This method of sewage disposal is most common in underdeveloped countries, but it also prevalent in quasi-developed countries such as China, India, and Iran.

Sanitation is the hygienic means of preventing human contact from the hazards of wastes to promote health. Hazards can be either the physical, microbiological or chemical agents of disease. Wastes that can cause health problems include human and animal fecal material, solid wastes, domestic wastewater (e.g., sewage, sullage, greywater), industrial wastes, and agricultural wastes. Hygienic means of prevention can be by using engineering solutions (e.g., sewerage and wastewater treatment), simple technologies (e.g., latrines, septic tanks), or even by personal hygiene practices (e.g., simple handwashing with soap). Despite known methods of sanitation, it is estimated that up to five (5) million people die each year from preventable waterborne diseases as a result of inadequate sanitation and hygiene practices.

In addition to the developing world and other areas where access to potable water and sanitation are significant issues, access to sanitary water sources also becomes an issue in both the developing and the westernized world during health scares and in the wake of natural disasters.

Health scares happen when there is leakage of dangerous biological or chemical contamination agents into local water supplies. Such contamination can be caused by run-off of agricultural growth or pesticide agents into a community's water supply, sewage leakages, or other forms of contamination. At such times, affected populations are informed by public health officials not to drink from the contaminated public water supply and to stick to sanitary water sources.

In the wake of a natural disaster such as a flood, hurricane, tornado, tsunami, or earthquake, the potable water supplies in even developed countries may be interrupted due to contamination from raw sewage or toxic chemicals.

During such natural disasters, infrastructures break down and populations are cut off from their normal public potable water sources. Further, during such times transportation and access to alternative emergency water sources becomes limited.

To combat the problems caused by lack of access to potable water, lack of resources and contamination, both in developing countries without adequate infrastructures and in westernized countries during health scares and in the wake of natural disasters, many international aid organizations and emergency relief services have developed water storage containers and sanitation systems to supply at-risk populations with sanitized water.

Present devices include emergency water filters for the removal of biological pathogens from the water, water drums (large containers, thirty (30) to fifty (50) gallons, made of polyethylene food grade plastic used to transport water to at-risk areas), emergency water rations in foil pouches, germicidal treatment tablets for emergency disinfection of drinking water, water bladders for use in a bathtub, transportable plastic water jugs, and inflatable water bags.

The main problems with the present devices used to supply potable water to emergency disaster areas and developing countries in need of sanitary water are four-fold: high cost, difficulty in transporting, sanitation, and ease of use.

Emergency water filtration systems and germicidal tablets that sanitize a large enough quantity of water for a large population can be expensive. Further, use can be complicated and failure to use such systems properly can result in re-contamination of water supplies. Accordingly, such systems are often not economically or practically reasonable.

Water drums and plastic water jugs can be expensive, hard to transport and susceptible to contamination during use. These containers are usually made of polyethylene food grade plastic, and are in a thirty (30) to fifty (50) gallon size. Transport of such containers to the at-risk area is usually by truck or airline freighter. Once filled, the containers are heavy and burdensome to load and transport. The container's rigid shape limits the number of containers that can be transported at one time. Further, the added weight of the plastic container results in a higher price of transport; i.e., more fuel is needed to get the containers to their desired location. Further, in use, the lid of the drum is opened to allow access to the water inside, or a twist cap/opening system can be utilized. The wide opening of such access systems can lead to a contamination of the water supply in the drum or plastic container as it is utilized by a number of different people in an emergency situation.

Further, as the wide opening is open to the outside ambient air, the water supply housed in the jug or drum is further susceptible to contamination by airborne particulate.

Another major problem with plastic bottles and drums is that they must be washed and sanitized between every use. This adds to the cost of such water storage systems and is a particular problem in the developing world where water is already scarce, and the drums and jugs must be re-transported to a washing station for further sanitation after use.

The present emergency water rations in foil pouches and inflatable water bags, while easier to transport and lower in cost, have sanitation and ease of use concerns. Some bags are simply "cut open" to access the water. Such designs are easily contaminable, and not easily stored after opening. In other bagged systems that use a pump, the initial puncturing of the bag can be difficult, often resulting in holes in both sides of the bag or contamination of the water source from repeated puncturing attempts. Further, the foil bags are not usually recyclable, adding to waste concerns in disaster and developing areas. Lastly, although some inflatable water bags may be reused, they must be washed and sanitized between each use, raising the same problems of cost and transport that were previously mentioned when discussing sanitation of the plastic bottles and drums between use.

Accordingly, there is a need in the emergency disaster supply and international aid fields for a method of dispensing potable water to populations in need that is economical, easy to transport, easy to use, and minimizes risk of contamination.

SUMMARY

The following is a summary of the invention in order to provide a basic understanding of some of the aspects of the invention. This summary is not intended to identify key or critical elements of the invention or to delineate the scope of the invention. The sole purpose of this section is to present some concepts of the invention in a simplified form as a prelude to the more detailed description that is presented later.

Due to these and other problems in the art, disclosed herein is a sanitary system for dispensing potable water wherein a bagged fluid, such as water, is dispensed via a stabilizing grommet and a spiked water dispensing device such that risk of contamination to the bagged water is diminished.

In one embodiment of the method for providing potable fluids, the method is comprised of the steps of: a) puncturing a bag of potable fluid with a spiked fluid dispensing device, wherein the spiked fluid dispensing device is comprised of a shaft, a spiked tip and a dispensing cover; and b) dispersing fluid therefrom. In this method, once the bag is punctured by the spiked fluid dispensing device, the bag forms a seal around the shaft of the spiked fluid dispensing device to prevent leakage.

In one embodiment of this method for providing potable fluids, the spiked fluid dispensing device further comprises a base in addition to a shaft, a spiked tip and a dispensing cover.

Also disclosed herein is an embodiment of a method for providing potable fluids, comprising the steps of: a) attaching a stabilizing grommet to an exterior wall of a bag of potable fluid; b) puncturing the bag of potable fluid through the central opening of the stabilizing grommet with a spiked fluid dispensing device, wherein the spiked fluid dispensing device is comprised of a shaft, a spiked tip and a dispensing cover; and c) dispensing fluid therefrom. In this embodiment of the method, once the bag is punctured by the spiked fluid dispensing device, the bag forms a seal around the shaft of the spiked fluid dispensing device to prevent leakage.

In one embodiment of this method for providing potable fluids with a stabilizing grommet, the spiked fluid dispensing device further comprises a base in addition to a shaft, a spiked tip and a dispensing cover.

In another embodiment of this method for providing potable fluids with a stabilizing grommet, the method further comprises, prior to the step of attaching, the step of: sanitizing the exterior wall of a bag of potable fluid.

In one embodiment, this step of sanitizing comprises removal of a patch attached to the exterior wall of the bag of potable fluid.

In another embodiment of this method for providing potable fluids with a stabilizing grommet, there is a first locking mechanism on the exterior wall of the shaft and there is a second locking mechanism in the central opening of the stabilizing grommet wherein the first locking mechanism locks into the second locking mechanism after the step of puncturing.

In another embodiment of this method for providing potable fluids with a stabilizing grommet, the central opening of the stabilizing grommet is polygonally shaped and the shaft of the spiked fluid dispensing device is correspondingly polygonally shaped such that the polygonal shape of the shaft and the polygonal shape of the central opening lock the shaft into a stable position in the grommet after the step of puncturing.

Also disclosed herein is an embodiment of a system for providing a transportable potable fluid, comprising: a bag of potable fluid; and a spiked fluid dispensing device, comprised of a shaft, a spiked tip and a dispensing cover attached to the bag, but not puncturing said bag; wherein a user punctures the bag with the spiked fluid dispensing device and dispenses fluid therefrom; and wherein once the bag is punctured by the spiked fluid dispensing device, the bag forms a seal around the shaft of the spiked fluid dispensing device to prevent leakage.

In an embodiment of this system, the spiked fluid dispensing device further comprises a base in addition to a shaft, a spiked tip and a dispensing cover.

In another embodiment of this system, the system further comprises a stabilizing grommet wherein the stabilizing grommet is attached to the bag prior to puncturing and the user punctures the bag with the spiked fluid dispensing device through the central opening of the grommet.

In another embodiment of this system, the central opening of the stabilizing grommet is polygonally shaped and the shaft of the spiked fluid dispensing device is correspondingly polygonally shaped such that the polygonal shape of the shaft and the polygonal shape of the central opening lock the shaft into a stable position in the grommet after the step of puncturing.

In another embodiment of this system, the system further comprises a patch attached to the exterior wall of the bag wherein the patch is removed prior to the user puncturing the bag and the user punctures the portion of the exterior wall of the bag that was formerly occupied by the patch.

In another embodiment of this system, the system further comprises an overwrap around the bag wherein the overwrap is removed prior to the user puncturing the bag.

In another embodiment of this system, the system further comprises the exterior wall of the bag being sanitized prior to the puncturing and wherein the puncturing occurs at the sanitized portion of said bag.

In another embodiment of this system, there is a first locking mechanism on the exterior wall of the shaft and there is a second locking mechanism in the central opening of the stabilizing grommet wherein a user locks the first locking mechanism into the second locking mechanism after the user punctures the bag.

Also disclosed herein is a method of providing potable fluid in emergency situations and to at-risk populations comprising: a) transporting a bag of potable fluid, a stabilizing grommet, and a spiked fluid dispensing device, comprised of a shaft, a spiked tip, a base and a dispensing cover to the required emergency site; b) attaching the stabilizing grommet to the exterior wall of said bag of potable fluid; c) grasping the stabilizing grommet attached to the wall of said bag of potable fluid; d) puncturing said bag of potable fluid through the central opening of said stabilizing grommet with a spiked fluid dispensing device, wherein said spiked fluid dispensing device is comprised of a shaft, a spiked tip and a dispensing cover; and e) dispensing fluid therefrom; wherein once the bag is punctured by the spiked fluid dispensing device, the bag forms a seal around the shaft of said spiked fluid dispensing device to prevent leakage.

In one embodiment of this method of providing potable fluid in emergency situations and to at-risk populations, the central opening of the stabilizing grommet is polygonally shaped and the shaft of the spiked fluid dispensing device is correspondingly polygonally shaped such that the polygonal shape of the shaft and the polygonal shape of the central opening lock the shaft into a stable position in the grommet after the step of puncturing.

In another embodiment of this method of providing potable fluid in emergency situations and to at-risk populations, the exterior wall of the bag is sanitized prior to the attaching and the grommet is attached over the sanitized portion of the bag, such that the puncturing occurs at the sanitized portion of said bag.

In another embodiment of this method of providing potable fluid in emergency situations and to at-risk populations, the sanitization comprises removal of a patch attached to the exterior wall of the bag of potable fluid.

BRIEF DESCRIPTION OF THE DRAWINGS

FIG. 8(*a*) provides a perspective view of an embodiment of the polygonal fluid dispensing device. FIG. 8(*b*) provides a side view of the polygonal fluid dispensing device. FIG. 8(*c*) provides an interior view of the shaft of the polygonal fluid dispensing device. FIG. 8(*d*) provides a perspective view of a stabilizing grommet with a polygonal central opening.

DESCRIPTION OF THE PREFERRED EMBODIMENT(S)

Figure 1:
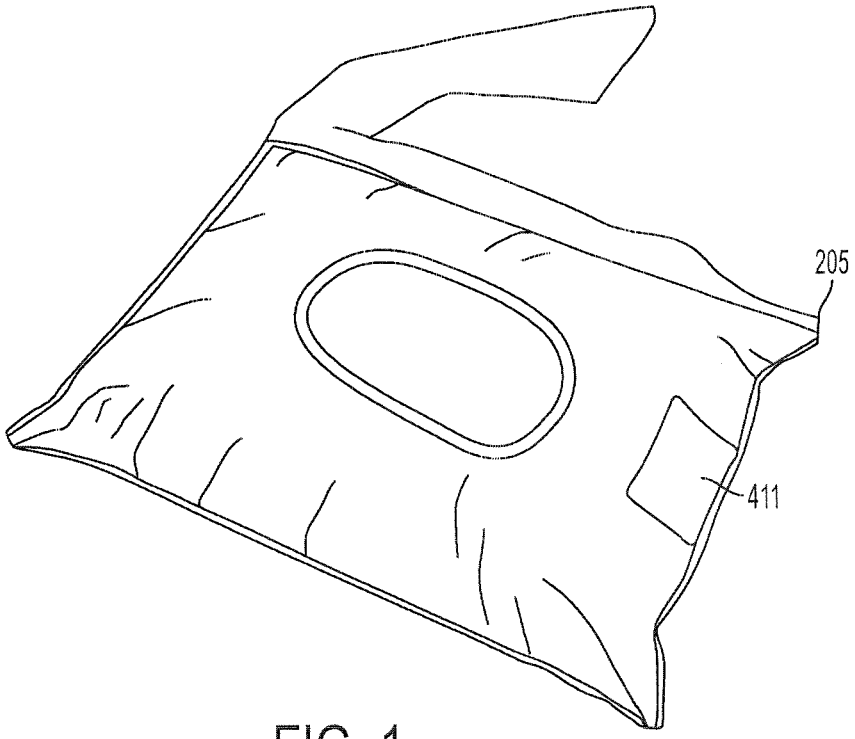
FIG. 1 provides a perspective view of an embodiment of the fluid-filled bag filled with water.

This disclosure provides systems and methods for dispensing potable fluids which are economical, easy to use, and minimize risk of contamination. Generally, the disclosed systems and methods consist of fluid dispersion wherein a bagged fluid, such as water, is dispensed via a stabilizing grommet and a spiked water dispensing device such that risk of contamination to the bagged water is diminished. As such, the general components of the embodiment disclosed herein are a hermetically sealed bag of fluid, and the spiked fluid dispensing device. In an embodiment, there may also be provided a stabilizing grommet used to enhance the spike connection. The generally defining aspects and characterizations of each of these individual components will be discussed in the present disclosure, followed by a general description of their interaction with each other in the disclosed systems and methods.

Generally, the initial component of the system is a hermetically sealed bag of fluid (205). While water is the preferred substance transported by the bag (205), this application contemplates any liquid suitable for human consumption as a possible fluid to be stored within the bag (205). In the interests of simplicity, the fluid will be identified as potable water in the present disclosure. In a preferred embodiment, the bag (205) is made of a thin, flexible, plastic film or organic polymer material and is heat sealed to create a hermetic seal. It is preferable that the plastic material is flexible and pliable such that it does not impart a rigid shape to the fluid. However, any type of material known to be used to form a bag for transport of food or water now, or in the future, known to those skilled in the art is contemplated. Similarly, any sealing or closing mechanism known to those of skill in the art now, or in the future, for the closing or securing of a fluid-filled bag is contemplated in this application. The bag (205) may also be of any suitable construction. Preferably, the bag (205) comprises a single-layer film wall. In an alternate embodiment, the bag (205) may be constructed with several plies of material or a set of bags placed within one another. Such a multi-layer bag system may include what is commonly referred to in the art as a secondary containment or an overwrap. For the embodiment of the bag (205) that has several layers, generally it is contemplated that one or more of the layers must be removed prior to puncturing the bag (205) with the spiked fluid dispensing device (508) (a process which will be discussed later in this disclosure).

Further, in another embodiment, a portion of the exterior surface area of the bag (205) will be covered with an adhesive patch (411). This patch (411) will generally function as a secondary barrier to possible contaminates that may make their way onto the bag (205) exterior during manufacture and/or transport. It is contemplated that this patch (411) will be removed immediately prior to the time of puncturing the bag (205) with the spiked fluid dispensing device (508). In one embodiment, it is contemplated that the bag (205) will have an attachment hole or insertion point such that the bag (205) can be attached to a ring, hook or other point of attachment and can be more easily transported.

An exemplary embodiment of the bag (205) is illustrated in FIG. 1. While the bag (205) of FIG. 1 is generally in a rectangular shape, such shape is not determinative and any shape known to one skilled in the art for shaping a fluid-filled bag is contemplated in this disclosure. Further, the carrying capacity of the bag (205) is not determinative, as this application contemplates any size bag (205) that proves practical for a given emergency or other disaster relief situation. However, it is preferred that the bag (205) hold around three (3) gallons of water to provide for relatively easy transport by hand, while still supplying a reasonable volume.

Figure 2:
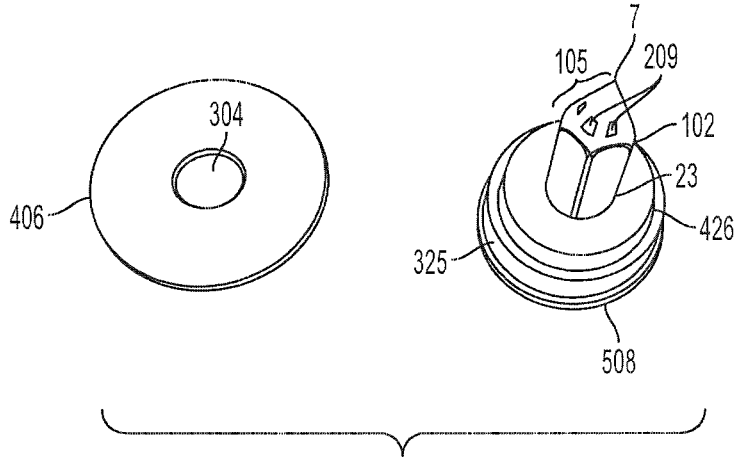
FIG. 2 provides a perspective view of an embodiment of the stabilizing grommet and the spiked water dispensing device separated from a fluid-filled bag.

Another component of the embodiment disclosed herein is the stabilizing grommet (406). However, it is important to note that while the principle embodiment disclosed herein is described as utilizing a stabilizing grommet (406), this component is not necessarily used in every embodiment of the systems and methods described herein. An exemplary embodiment of the stabilizing grommet (406) is shown in FIG. 2. Further, an embodiment of the stabilizing grommet (406) after attachment to the bag (205) is shown, from both a top perspective view and a side view, in FIGS. 3 & 4. As illustrated in these FIGS., the stabilizing grommet (406) is generally a circular shaped piece of rubber, with one adhesive side, and a central opening (304) in the middle that corresponds in size to the diameter of the shaft (102) of the spiked fluid dispensing device (508). While the exemplary stabilizing grommet shown in the FIGS. is created from a rubber material, this is not determinative. This application contemplates the manufacture of the stabilizing grommet from any material known to those of skill in the art that can be easily and stably attached to a fluid-filled bag (205), can be easily grasped by a user when inserting the fluid dispensing device (508), and has a low probability of puncturing the fluid-filled bag (205) to which it eventually becomes attached. As such, some of the contemplated materials include rubber, a rubber-like material, or a hard or soft plastic or metal. Similarly, while a circular shaped grommet (406) is shown in FIG. 2, this application contemplates any shape of grommet that can be easily gripped with an opening (304) that corresponds in shape to the shape of the shaft (102) of the spiked fluid dispensing device (508) known to those skilled in the art. One such example of this embodiment is shown in FIG. 8. In addition, any adhesive mechanism known to those of skill in the art that would allow for a quick, easy and stable attachment to the fluid filled bag (205) is contemplated in this disclosure.

Further, in an alternative embodiment, the stabilizing grommet (406) does not have adhesive on one side and is attached to the bag (205) via a separate adhesive element.

While the embodiments of FIGS. 2-7 contemplate a cylindrically shaped shaft (102) and stabilizing grommet (406) with a circular central opening (304), as depicted in FIGS. 8(*a*), 8(*b*), 8(*c*), and 8(*d*), the central opening (304) of the stabilizing grommet (406) may be polygonal in shape to correspond to a shaft (102) of a spiked fluid dispensing device (508) having a polygonal cross-section. While the embodiment of FIG. 8 shows a shaft (102) with a cross-section having five sides (901), forming a pentagon, any polygonal shape (i.e., a plane figure that is bounded by a closed path or circuit, composed of a finite number of straight line segments) is contemplated and the shaft (102) may have any number of corresponding sides. However, it is important to note that the shaft (102) and corresponding central opening (304) will most commonly be in a shape which is more regular with sides (901) being at a relatively even size.

The polygonal shape of the shaft (102) of the fluid dispensing device (508) and the corresponding central opening (304) generally work in tandem to act as a locking mechanical fastening device. In other words, once the shaft (102) is inserted into the central opening (304) of the grommet (406) in this embodiment, such that the bag (205) is punctured, a side (901) of the shaft (102) will interact with a corresponding surface (903) of the grommet's (406) central opening (304) so that a user will not be able to spin the shaft (102) around, either to the left or right, in the central opening (304). Rather, the edges (901) and points of the polygonal shape of the shaft (102) and the corresponding central opening (304) of the grommet (406) act to prevent such spinning and, accordingly, lock the shaft (102) into a stable position in the grommet (406). This locking action acts to inhibit any leaking that could occur from spaces that could be opened at the area of puncturing as a result of a user, whether purposefully or accidentally, rotating the shaft (102) after insertion. In addition, this locking action also generally ensures that dispensing is in a fixed direction to inhibit possible difficulties in using the device top dispense of the fluid dispensing device (508).

Further, while the embodiment of FIG. 8 provides that the shaft (120) is of uniform cross-section along its entire length, this is by no means required and in an alternative embodiment the shaft (120) may comprise multiple portions. For example, a lower portion closer to the tip (105) may be circular in cross-section while the upper portion (further from the tip) has a polygonal cross section; the upper portion providing for locking, while the lower portion may provide for easier alignment during the spiking action. Transitions between the two portions may be smooth or sudden depending on the embodiment. Generally, a smooth transition would be used if the upper portion will at least partially pass into the bag, while a more sudden transition may be desirable if the upper portion remains outside of the bag and is used solely for the purpose of locking.

Figure 9:
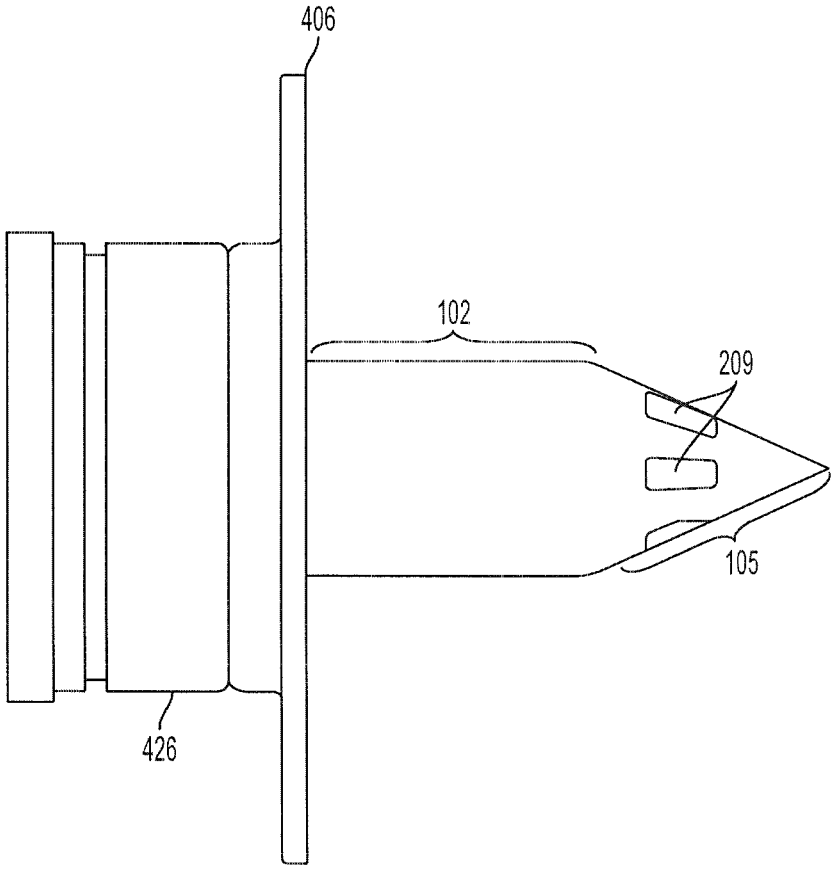
FIG. 9 provides a view of an embodiment of the grommet and spiked fluid dispensing device wherein the fore end of the shaft of the spiked fluid dispensing device, adjacent to the base, has a first locking mechanism on its exterior surface and the interior of the central opening of the stabilizing grommet has a corresponding second locking mechanism on its exterior surface.
Figure 10:
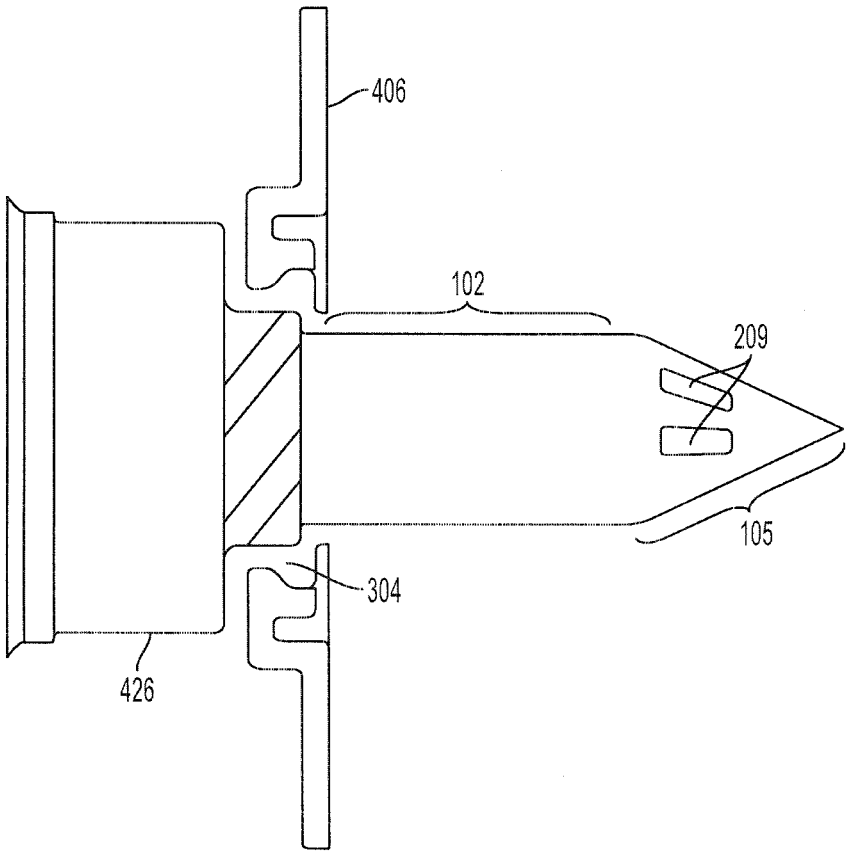
FIG. 10 provides a internal view of the locking mechanism of an embodiment of the grommet and spiked fluid dispensing device wherein the fore end of the shaft of the spiked fluid dispensing device, adjacent to the base, has a first locking mechanism on its exterior surface and the interior of the central opening of the stabilizing grommet has a corresponding second locking mechanism on its exterior surface.

In another embodiment, the stabilizing grommet (406) and the spiked fluid dispensing device (508) are further comprised of mating helical ridges (i.e., thread) locking mechanisms. As depicted in FIGS. 9-10, in this embodiment, a first portion of the locking mechanism is located on the exterior wall of the shaft (102) of the spiked fluid dispensing device (508). Generally, this first locking mechanism is located at the fore (23) end of the shaft (102) near the base (426). However, this positioning is not determinative, and this disclosure contemplates any positioning of the first locking mechanism on the shaft (102) or base (426) of the spiked fluid dispensing device (508). Further, while the first locking mechanism shown in the FIGS is an external thread, it is contemplated that this first locking mechanism could be an internal thread, or any other fastener or locking mechanism known to those of skill in the art that could function to lock the spiked fluid dispensing device (508) and the stabilizing grommet (406) together.

The second portion of the locking mechanism of this embodiment, depicted in FIGS. 9 and 10, is located within the central opening (304) of the stabilizing grommet (406). This second locking mechanism is a mating locking mechanism to the first locking mechanism such that, when conjoined in the proper manner, the corresponding locking mechanisms lock the spike fluid dispensing device (508) into the stabilizing grommet (406). In the embodiment shown in the FIGS, this second locking mechanism is an internal thread, however any thread, locking device or fastener known to those of skill in the art that could function to lock the second locking mechanism of the stabilizing grommet (406) into the first locking mechanism of the spiked fluid dispensing device (508) is contemplated in this application.

In the embodiment of the locking stabilizing grommet (406) and spiked fluid dispensing device (508) shown in FIGS. 9-10, it is contemplated that a user would grasp the stabilizing grommet (406) and thrust the shaft (102) of the spiked fluid dispensing device (508) through the central opening (304) of the stabilizing grommet (406). Once thrust through the central opening (304) of the stabilizing grommet (406) (and into the bag (205)), the external threads of the first locking mechanism will come into contact with the internal threads of the second locking mechanism. At this point, the corresponding helical threads will be turned, or "screwed," into each other generally by a clockwise rotation (however a counterclockwise rotation is also contemplated in this disclosure), locking the spiked fluid dispensing device (508) into the stabilizing grommet (406).

Regardless of shape, the systems and their methods of use will generally be similar. One such embodiment is illustrated in FIGS. 2-7. While FIG. 2 generally shows a spiked fluid dispensing device (508) made of plastic, this application contemplates spiked fluid dispensing devices (508) made of any material known to those skilled in the art that allows for the easy and sanitary puncturing of a fluid-filled bag, provides stability, and forms a seal prohibitive to leaking of the bag. The embodiment of the spiked fluid dispensing device (508) depicted in FIG. 2 is generally comprised of five main elements: a shaft (102), a spiked tip (105), openings in the spiked tip (209), a base (426) and a dispensing cover (325).

The shaft (102) of the spiked fluid dispensing device (508) of FIG. 2 has an internal volume (117) and an exterior shell (56). It is contemplated that the shaft (102) of the spiked fluid dispensing device (508) can take on a number of different shapes. Generally, any shape with an internal volume (117) through which fluid can flow is contemplated in this disclosure. The shaft (102) of the spiked fluid dispensing device (508) has a fore (23) and an aft (7) end with a length there-between. The length of the shaft (102) can be any length needed such that fluid can easily flow through the internal volume (117) from the aft (7) to the fore (23) end of the shaft (102).

The spiked tip (105) of the spiked fluid dispensing device (508) is generally cone shaped. It is important to note that any shaped tip that could effectively and efficiently pierce the fluid-filled bag (205) and through which fluid could easily flow is contemplated in this disclosure. However, for the convenience of the present disclosure, the spiked tip (105) will generally be described as cone shaped as this is often a preferred shape to inhibit leakage. The base of the cone shaped spiked tip (105) is connected to the aft end (7) of the shaft (102) such that fluid can flow through the internal volume (117) of the shaft (102). The terminating point (6) of the spiked tip (105) is generally located aft (7) of the shaft (102).

The third element of the spiked fluid dispensing device (508) is the openings in the spiked tip (105). These openings are cut holes in the structure of the spiked tip (105) that allow for access into the interior volume (117) of the spiked tip (105) and the interior volume (117) of the shaft (102). While triangular in shape in the embodiment depicted in FIG. 2, it is contemplated that these openings can take any shape known to those of skill in the art that allows for fluid to flow into the internal volume (117) of the spiked tip (105) and the interior volume of the shaft (102). Further, while four (4) openings are depicted in the spiked tip (105) of FIG. 2, this disclosure contemplates any spiked tip (105) with one or more openings (209).

The fourth element of the spiked fluid dispensing device is the base (426). Located on the fore (23) end of the shaft (102), the base is generally comprised out of the same unitary piece of plastic as the shaft (102) and the spiked tip (105). However, this is not determinative, and it is contemplated that the spiked tip (105), shaft (102) and base (426) can be formed of separate pieces and then joined together, in a manner known to those of skill in the art, to form a single spiked fluid dispensing device (508). Furthermore, as shown in FIG. 2, the base (426) is generally larger in diameter than the shaft (102) and generally the same shape as the shaft (102). However, again, these dimensions are not determinative and any sized or shaped base (426) to which the spiked fluid dispensing device (508) can be easily and securely attached is contemplated in this disclosure. In fact, it is contemplated as a possible embodiment that the base (426) is simply an extension of the shaft (102). In other words, it is contemplated that some embodiments of the spiked fluid dispensing device (508) will not have a base (426), and the cover (325) will rather be directly attached to the fore (23) end of the shaft (102).

The fifth element of the spiked fluid dispensing device (508) is the dispensing cover (325). In the embodiment depicted in FIG. 5, the dispensing cover (325) is generally comprised of rubber, although any other material known to those of skill in the art that will form a tight seal with the base (426) of the fluid dispensing device (508) is contemplated. The dispensing cover (325) generally is placed around the exterior perimeter of the base (426) and forms a tight seal therewith. In the depicted embodiment, the dispensing cover (325) has a knob (250) on its exterior parallel to the spiked tip (105) that, when pushed upwards, opens a dispensing slot (404) between the base (426) and the cover (325) through which fluid can flow. While this embodiment of the dispensing cover (325) is depicted in the FIGS., it is important to note that this application contemplates any dispensing cover (325) device known to those of skill in the art that will easily and effectively attach to the shaft (102) or base (426) of the fluid dispensing device, and control the release of fluids from therein by user manipulated control.

The components of the system for dispensing fluids described herein (i.e., the grommet (406), the spiked fluid dispensing device (508), and the bagged fluid (205)) generally interact together in a water dispensing system in the following manner. First, the spiked tip (105) terminus end of the spiked fluid dispensing device (508) is pushed into the outer wall of the bag (205), granting the spiked fluid dispensing device (508) access to the fluid inside the bag (205). It is contemplated that this "spiking force" can come from a user thrusting the spiked fluid dispensing device (508) into the bag (205), among other sources.

Once the bag (205) is punctured by the spiked dispensing device (508), the perforated portion of the bag (205) forms a seal around the shaft (102) of the spiked fluid dispensing device (508), such that there is generally no leakage or seepage of any significant amount in the connection from the fluid housed in the bag (205) to the fluid dispensing device (508). Sealing of the bag (205) about the shaft (102) of the fluid dispensing device (508) is accomplished when the shaft (102) is sized and shaped so that as the wall of the bag (205) is deformed and broken by the spiked tip (105), the integrity of the wall of the bag (205) remains intact around the entire circumference of the shaft (102) of the spiked fluid dispensing device (508).

Generally, the integrity of the wall of the bag (205) remains intact around the shaft (102) in a direction perpendicular to the circumference thereof. In an embodiment, the physical properties of the bag material (e.g., elasticity) promote sealing of the bag material around the shaft (102). The seal is so tight that, even when a larger amount of pressure is applied to the bag, the spiked dispensing device (508) stays in place in the bag (205). Standing on the bag has not been able to destabilize an inserted spiked fluid dispensing device (508) in trial runs of an embodiment of the device.

Figure 3:
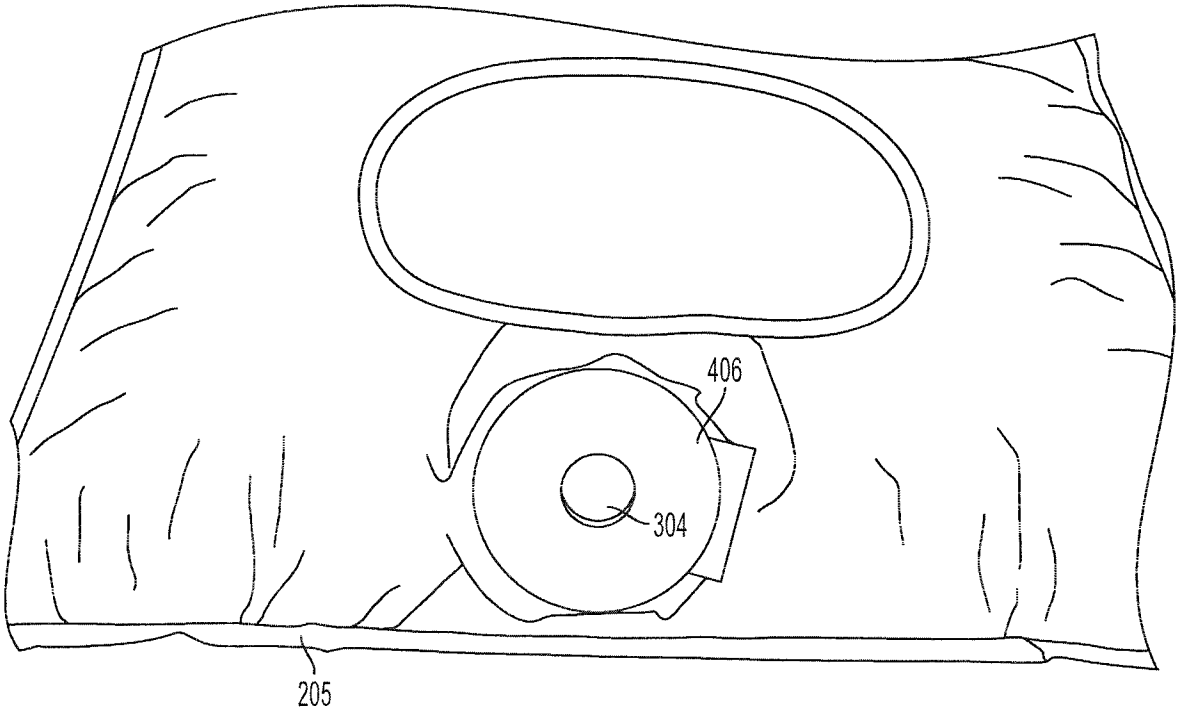
FIG. 3 provides a top perspective view of an embodiment of the stabilizing grommet after attachment to the bag but before puncturing.
Figure 4:
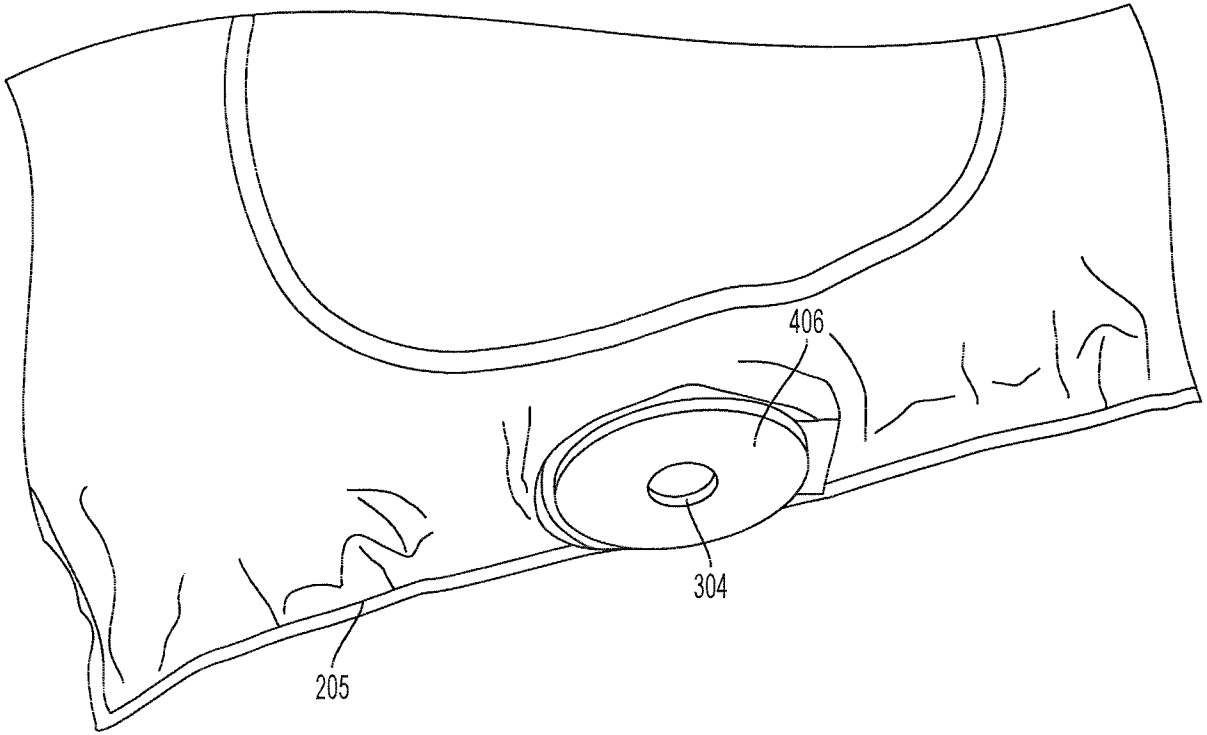
FIG. 4 provides a side view of an embodiment of the stabilizing grommet after attachment to the bag but before puncturing.
Figure 5:
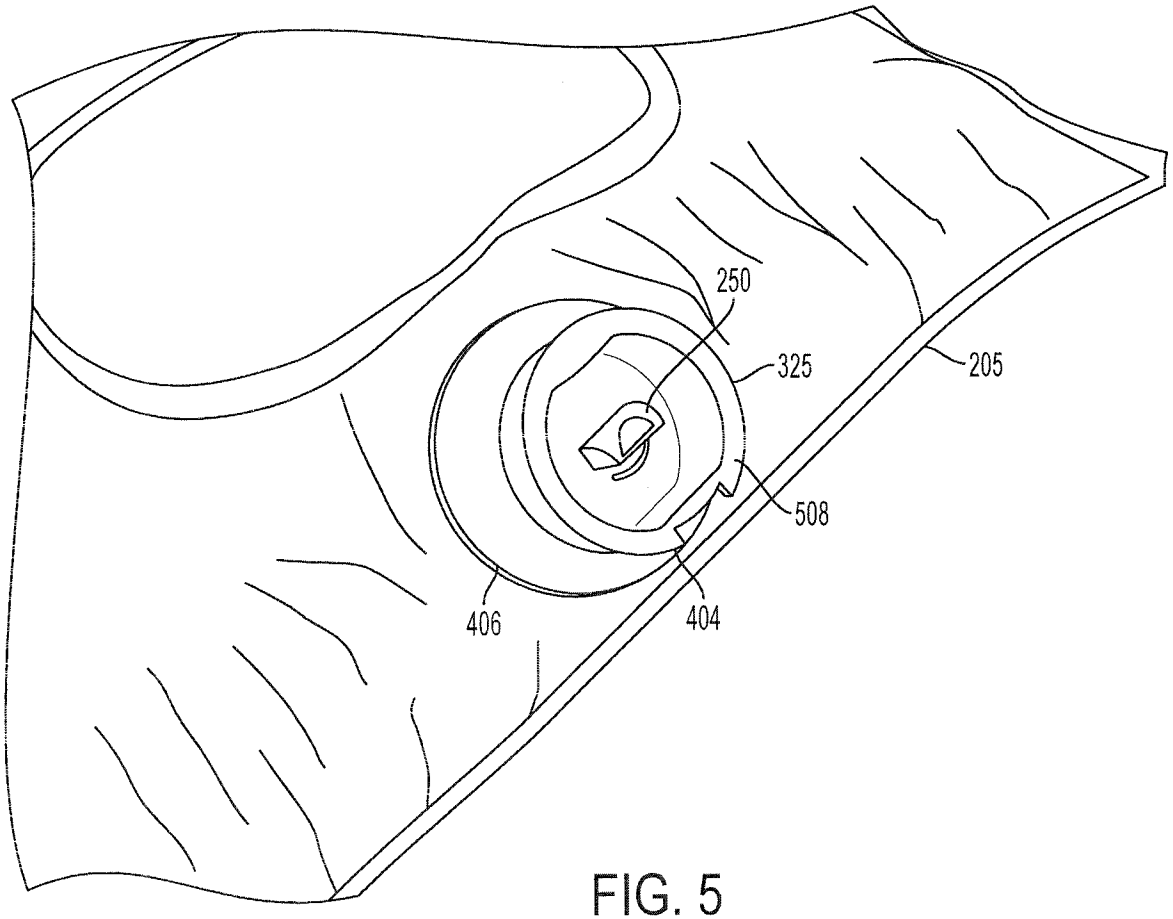
FIG. 5 provides a top perspective view of an embodiment of the fluid-filled bag after the stabilizing grommet has been attached and after the bag has been punctured through the stabilizing grommet with the spiked water dispensing device.

Generally, in the embodiment described herein, the components of the sanitary system for dispensing potable water are used together in the system as follows. First, a user would attach the stabilizing grommet (406) to the bag (205) (again, this step is not necessarily a component of all embodiments). In an embodiment, the stabilizing grommet (406) is attached to the bag (205) via its adhesive side, by placing the adhesive side of the grommet (406) on the bag (205) and pressing until a firm attachment is achieved. In another embodiment, the grommet (406) is attached to the bag (205) via a separate adhesive element, such as, but not limited to, double sided tape, a liquid adhesive or some other form of permanent adhesive element known to those skilled in the art. A top perspective view of an embodiment of the grommet (406) and the bag (205) after attachment is illustrated in FIG. 3. A side perspective view of an embodiment of the grommet (406) and the bag (205) after attachment is shown in FIG. 4.

In FIGS. 3, 4, 5 & 7, the stabilizing grommet (406) has been attached to a terminal end of the bag (205). While this positioning of the grommet (406) is preferred, as it utilizes the force of gravity when the bag (205) is hung, as in FIG. 7, such that the fluid inside the bag (205) naturally flows into the area of grommet (406) attachment, this positioning is by no means determinative. This application contemplates positioning and attachment of the grommet (406) anywhere on the outer surface of the bag (205).

In an embodiment, prior to attachment of the grommet (406) to the surface of the bag (205), a user would sanitize the outer surface of the bag (205) in the area of proposed attachment. This sanitation can be accomplished by a sanitizing or alcohol wipe, soap and water, cleaning aid and paper towel or by any other method known to those skilled in the art. In an embodiment, this sanitizing wipe or similar structure may be provided in a pouch attached to the exterior of the bag (205) to provide for ease of providing sanitation with the bag (205). In another embodiment, a user will remove the patch (411), secondary overwrap, or secondary bag on the bag (205) provided for sanitary reasons. Sanitation of the proposed area of attachment, prior to attachment, removes or destroys any contaminates that may be on the outside of the bag (205) as a result of transport and/or storage of the bags (205). Removal of those contaminates reduces the chances that they will be exposed to the fluid contents of the bag (205) at the time of perforation. Sanitation may also be performed on the spiked fluid dispensing device (508) either by having the spiked fluid dispensing device (508) similarly sanitized with the wipe or other cleaning material, providing the spiked fluid dispensing device (508) in its own sanitary enclosure, or providing the spiked fluid dispensing device (408) within the stabilizing overwrap or patch (411), but not penetrating the bag (205).

Once the stabilizing grommet (406) is attached to the bag (205), a user would grasp the spiked fluid dispensing device (508), with the dispensing cover (325) attached, with one hand, and the outer edge of the stabilizing grommet (406) with the other hand. The user would then thrust the spiked tip (105) terminus end of the spiked fluid dispensing device (508) through the circular opening (304) of the stabilizing grommet (406), thereby breaking the bag (205) at the point through the central opening (304). Then a user would push the dispensing cover (325) terminus end of the spiked fluid dispensing device (508) such that the shaft (102) would be forced into the interior of the bag (205) and the surface area of the stabilizing grommet (406) would come into direct contact with the surface area of the base (426) of the spiked fluid dispensing device (508). In the embodiment of the device in which the shaft (102) and the central opening (304) are polygonally shaped, the edges of the shaft (102) of the spiked fluid dispensing device (508) are lined up to correspond with the edges of the central opening (304) of the grommet (406) prior to insertion. Further, in the embodiment in which a stabilizing grommet (406) is not used, the user will grasp the bag (205) and thrust the spiked tip (105) terminus end of the spiked fluid dispensing device (508) directly into the bag (205) at a desired point, thereby breaking the bag (205) at that point. Then a user would push the dispensing cover (325) terminus end of the spiked fluid dispensing device (508) such that the shaft would be forced into the interior of the bag (205), and the exterior surface area of the bag (205) would come into direct contact with the surface area of the base (426).

Use of the stabilizing grommet (406) has a number of advantages in the act of puncturing. First, the grommet (406), with its easily graspable shape, gives a user an easy and defined point at which to hold onto the bag (205) during puncturing activity. As the bag (205), in its nature, is pliable, lightweight and generally amorphous, the easily graspable grommet (406) eases the process of puncturing the bag (205). Second, as the area of attachment can be sanitized prior to attachment of the grommet (406), and the grommet (406) defines a particularly small area inside the circular opening (304) for perforation, a user can be assured that contamination is less likely to occur during perforation. Third, the grommet (406) acts to ease any physiological factors, i.e., that the bag (205) will leak after attachment, that the water will spill, that the water will be contaminated, etc., that a user may have in perforating the bag (205) in an emergency or a disaster situation. This physiological factor is further eased by the embodiment of the system in which the central opening (304) and the shaft (102) are polygonal, as the locking feature of this embodiment only further indicates that leakage between the bag (250) and the spiked dispensing device (508) will not occur after puncturing.

Figure 6:
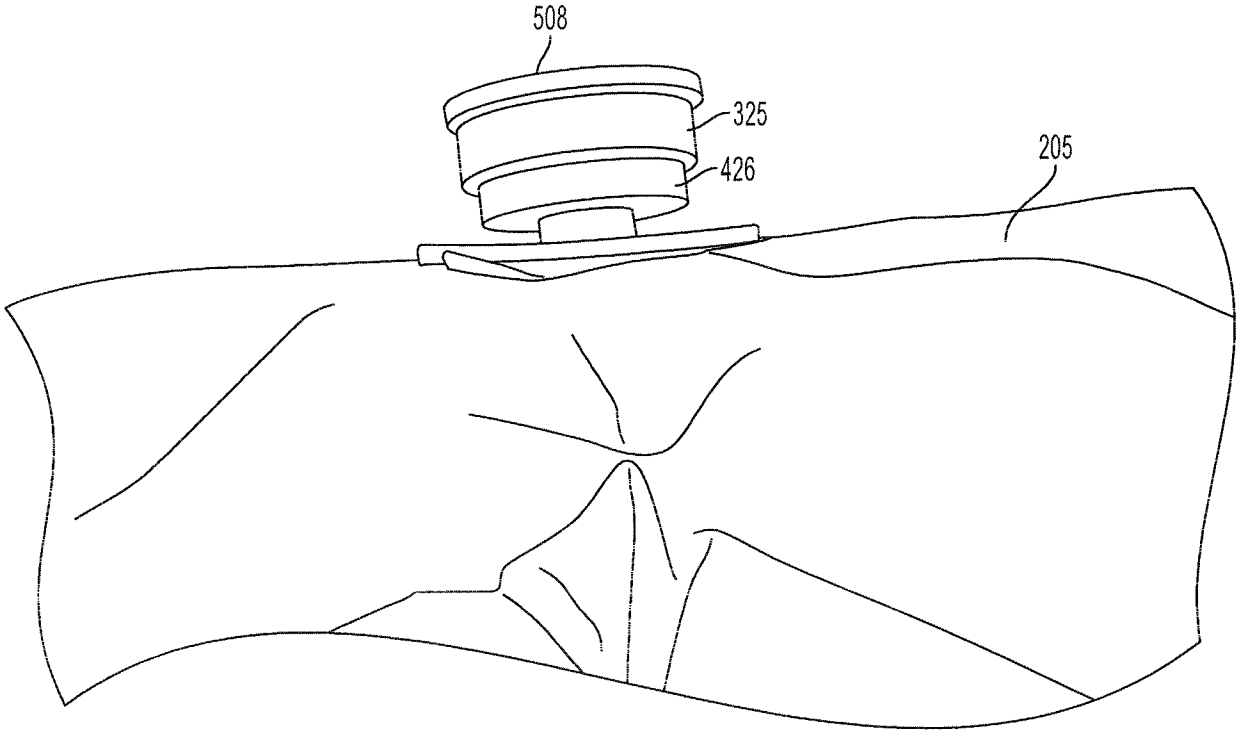
FIG. 6 provides another side view of an embodiment of the portable bag after the stabilizing grommet has been attached and after the bag has been punctured through the stabilizing grommet with the spiked water dispensing device.

Once inserted, the perforated portion of the bag (2.05) forms a seal around the shaft (102) of the fluid dispensing device (508) such that there is generally no leakage or seepage in the connection from the fluid housed in the bag (205) to the dispensing slot (404). As mentioned briefly, supra, the seal is so tight that, even when a large amount of pressure is applied to the bag (205), the spiked dispensing device (508) generally stays in place in the circular opening (304) of the stabilizing grommet (406). FIG. 6 illustrates the stability of the spiked fluid dispensing device (508) in the bag (205) after perforation. In this FIG. 6, an individual is applying outside pressure to the bag (205) via the force of his or her arms. As illustrated in FIG. 6, the fluid dispensing device (508) is stable and stays in place despite the outside exerted force.

Figure 7:
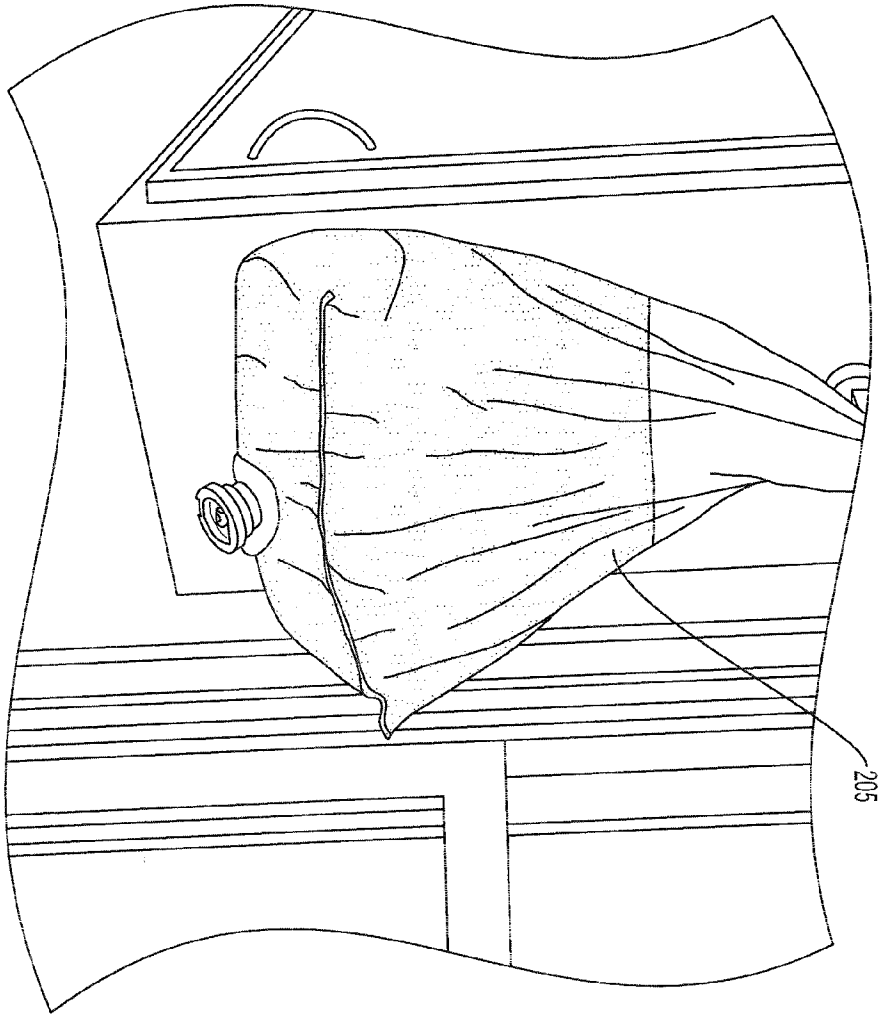
FIG. 7 provides a perspective view of an embodiment of the bagged fluid system hung from a point of attachment after puncturing.
Figure 8A:
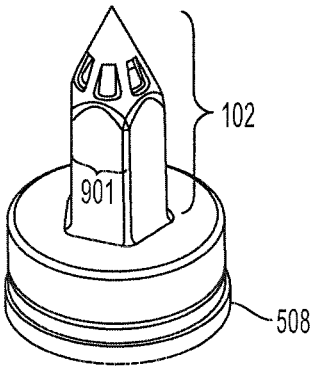
FIG. 8 provides a view of an embodiment of the grommet and spiked fluid dispensing device wherein the shaft of the spiked fluid dispensing device and the central opening of the stabilizing grommet are polygonal.
Figure 8B:
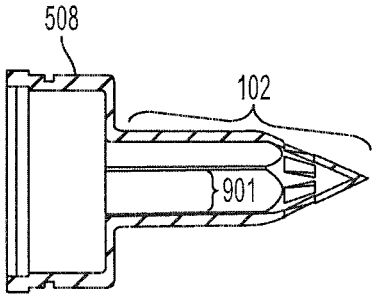
Figure 8C:
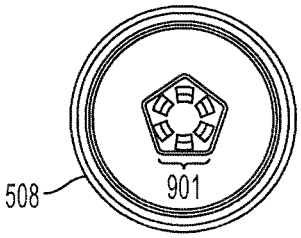
Figure 8D:
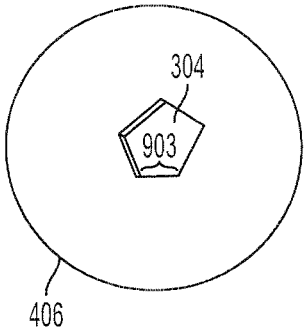

Once inserted into the bag (205), the spiked fluid dispensing device (508) can be used to access the water, or other liquid, housed inside the bag (205) by adding pressure to push the knob (250) in an upward motion/direction so that a dispensing slot (404) is opened. In alternative embodiments of the dispensing cover (325) an alternative opening or fluid dispensing mechanism known to those of skill in the art will be manipulated by the user in order to open the fluid-flow pathway. Further, to utilize gravity to ease the flow of the fluid out of the bag (205), a user may hang or attach the bag (205) to a hook or other point of attachment, as seen in FIG. 7.

The advantages of the present water dispersion system are numerous. First, this water dispersion system operates at a low cost. The system, including all its component parts, can be manufactured at a reduced price point compared to the prior art. Further, many components of the system can be reused. The bag (205) is recyclable, thus eliminating waste and the cost inherent in sanitizing a container between uses. This also eliminates excess trash and further debris that needs to be disposed of in an emergency or disaster relief situation. In addition, the spiked water dispensing device (508) can be reused on a number of different bags (205) and, due to the simplicity of its design and size, can be quickly and easily sanitized between uses if needed.

As the bag (205) of the system is recyclable and disposable, it is only utilized for a single-use or transport of fluid before it is disposed of and/or recycled. Accordingly, there is never the opportunity, as in the prior art, for contaminates to be introduced into the bag (205) between uses. This feature of the system greatly reduces the threat of contamination that was a significant concern in the prior art and does not require further transport of empty containers since the empty bags can be crushed prior to transport.

Second, this water dispersion system is easily transportable. Compared to the prior art, the present water dispersion system, is easy to handle and load for transporting. As the bag (205) does not have a rigid shape and is relatively small, it is feasible that more bags (205) can be loaded onto one truck or airplane for shipment. Further, the present water dispersion system is lighter in weight than previous water dispersion devices. This decreased weight lowers the cost of fuel needed to transport the bags (205) to at-risk areas, thereby lowering the overall cost of the entire system. Lastly, as an embodiment of the system contemplates attachment of the bag (205) to a hook, the bags (205) can be more easily transported in rural areas (via bike, cart, hands, etc.) in larger quantities than rigid plastic containers or drums.

The easily transportable nature of the bags (205) is a huge benefit in distribution of the system in the developing world where there is a lack of an adequate infrastructure. In these environments, road conditions, treks to rural communities in need of potable water, lack of adequate vehicles of transport, etc. can increase the burden, if not making it impossible, to distribute water with the systems of the prior art. The present system, however, can be easily carried by hand, bike, cart, animal, or any other type of transport commonly used in developing regions. Further, the present system is self-contained, i.e., as no additional container is needed to transport the water, this system is easier to distribute to populations in the developing world in need of potable water than many of the systems of the prior art. It is important to note that these benefits of distribution that are advantageous in the developing world due to their lack of infrastructure, are also advantageous in the westernized world at the time of a natural disaster or emergency when an area's infrastructure is dismantled and/or rendered unusable by the emergency situation. In these situations, the bags (205) can be distributed from a central location or packing plant resulting in an emergency water relief system that is easier to organize and manage in the time of a disaster.

Third, the present water dispersion system is easier to use than the prior art. The stabilizing grommet (406) and relatively short spike (408) structure gives a user an easy grasping point and area through which the spiked fluid dispersion device (508) can be thrust. This minimizes several problems that were inherent in other bagged water systems: puncturing dual holes in the bag, mispuncturing the bag; punching too big of a hole causing seepage; and punching a contaminated portion of the bag, thereby contaminating the water supply, among other problems. Further, the simple nature of the spiked fluid dispensing device (508) simplifies use and eliminates clogging and suction problems that can occur in pumps and other methods used in the prior art. In addition, no chemical or filtering processes, which can be complicated and easily contaminated, are utilized.

Fourth, the system is sanitary. The stabilizing grommet (406) allows a user to sanitize a particular point of puncturing on the bag (205) such that any contaminants outside the bag to not make their way inside at the time of penetration. Further, a new bag (205) is used for every transport, thereby eliminating the human error factor in re-sanitation. Finally, as there is a tight seal from the bag (205) to the spiked fluid dispersion device (508), there is diminished probability of contamination via a large opening to the air as in the plastic drums and plastic water containers.

Fifth, the present system is easy to supply to at-risk areas. As stated previously, this system is comprised of a small number of easy to use components. Outside of the bag (205), all a user needs is a stabilizing grommet (406) and a spiked fluid dispensing device (508). Further, a user can utilize a single grommet (406) and/or spiked fluid dispensing device (508) on a number of different bags (205). Accordingly, only the bags (205) need to be transported once an at-risk area has received an adequate supply of grommets (406) and devices (508). As only one component of the system needs to be transported in this scenario, this again eases the distribution burden of the present system.

Lastly, the present system is easier to store than the prior art. Disaster relief organizations, such as the Red Cross, FEMA, etc., recommend that individuals who live in at-risk areas such as Florida and the Gulf Coast for hurricanes, Oklahoma and Kansas for tornados, San Francisco for earthquakes, etc. store adequate emergency water supplies at home. Prior to the present system, food-grade plastic containers were commonly used for such potable water storage. As these containers have open-air dispersion openings, contamination is a common problem, as was discussed previously in this application. The bags (205) of the present system, however, have no open-air dispersion openings until the time of puncturing and use. These bags (205) are hermetically sealed off from outside contaminates until use, thus providing a better system for at-home or general storage situations.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A method for providing potable fluids, the method comprising:

providing a bag of potable fluid; and a spiked fluid dispensing device, wherein said spiked fluid dispensing device is comprised of a shaft, a spiked tip and a dispensing cover;

removing a patch from an exterior surface of said bag of potable fluid to reveal a sanitized area on said exterior surface;

attaching a stabilizing grommet to said sanitized area after said patch is removed;

puncturing said bag of potable fluid through a central opening in said stabilizing grommet with said spiked fluid dispensing device; and dispensing fluid from said bag of potable fluid;

wherein once said bag is punctured by said spiked fluid dispensing device, said bag forms a seal around said shaft of said spiked fluid dispensing device to prevent leakage.

2. The method of claim 1, wherein the spiked fluid dispensing device further comprises a base.

3. A method for providing potable fluids, the method comprising:

revealing a sanitized part of an exterior surface of a bag filled with potable fluid;

attaching a stabilizing grommet to said sanitized part of said exterior surface;

puncturing said bag filled with potable fluid through a central opening in said stabilizing grommet with a spiked fluid dispensing device, wherein said spiked fluid dispensing device is comprised of a shaft, a spiked tip and a dispensing cover; and dispensing fluid from said bag filled with potable fluid;

wherein once said bag is punctured by said spiked fluid dispensing device, said bag forms a seal around said shaft of said spiked fluid dispensing device to prevent leakage.

4. The method of claim 3, wherein said spiked fluid dispensing device further comprises a base.

5. The method of claim 3, wherein said step of revealing comprises removal of a patch attached to said exterior surface of said bag filled with potable fluid over said sanitized part.

6. The method of claim 3, wherein there is a first locking mechanism on an exterior wall of said shaft and there is a second locking mechanism in the central opening of said stabilizing grommet wherein said first locking mechanism locks into said second locking mechanism after said step of puncturing.

7. The method of claim 3, wherein said central opening of said stabilizing grommet is polygonally shaped and said shaft of said spiked fluid dispensing device is correspondingly polygonally shaped such that said polygonal shape of said shaft and said polygonal shape of said central opening lock said shaft into a stable position in said grommet after said step of puncturing.

8. A system for providing a transportable potable fluid, comprising:

a bag of potable fluid; and a spiked fluid dispensing device, comprised of a shaft, a spiked tip and a dispensing cover attached to said bag under a patch which is attached to an exterior surface of said bag, said spiked fluid dispensing device not puncturing said bag;

wherein a user removes said patch to free said spiked fluid dispensing device and punctures said bag with said spiked fluid dispensing device at said exterior surface where said patch was removed and dispenses fluid from said bag of potable fluid; and wherein once said bag is punctured by said spiked fluid dispensing device, said bag forms a seal around said shaft of said spiked fluid dispensing device to prevent leakage.

9. The system of claim 8, wherein said spiked fluid dispensing device further comprises a base.

10. The system of claim 8, further comprising a stabilizing grommet wherein said stabilizing grommet is attached to said exterior surface of said bag prior to puncturing but after said patch is removed and where said patch was removed from; and said user punctures said bag with said spiked fluid dispensing device through a central opening in said stabilizing grommet.

11. The system of claim 10, wherein said central opening of said stabilizing grommet is polygonally shaped and said shaft of said spiked fluid dispensing device is correspondingly polygonally shaped such that said polygonal shape of said shaft and said polygonal shape of said central opening lock said shaft into a stable position in said stabilizing grommet after said step of puncturing.

12. The system of claim 8, further comprising an overwrap around said bag wherein said overwrap is removed prior to said user puncturing said bag.

13. The system of claim 10, wherein there is a first locking mechanism on the exterior wall of said shaft and there is a second locking mechanism in said central opening of said stabilizing grommet wherein said user locks said first locking mechanism into said second locking mechanism after said user punctures said bag.

14. A method of providing potable fluid in emergency situations and to at-risk populations comprising:

transporting a bag of potable fluid, a stabilizing grommet, and a spiked fluid dispensing device, comprised of a shaft, a spiked tip, and a dispensing cover to the required emergency site, said bag being within an overwrap;

after said bag is at said required emergency site, removing said overwrap from said bag;

after said overwrap is removed, attaching the stabilizing grommet to the exterior wall of said bag of potable fluid;

after said stabilizing grommet is attached, puncturing said bag of potable fluid through the central opening of said stabilizing grommet with a spiked fluid dispensing device; and dispensing fluid from said bag of potable fluid;

wherein once said bag is punctured by said spiked fluid dispensing device, said bag forms a seal around said shaft of said spiked fluid dispensing device to prevent leakage.

15. The method of claim 14, wherein said central opening of said stabilizing grommet is polygonally shaped and said shaft of said spiked fluid dispensing device is correspondingly polygonally shaped such that said polygonal shape of said shaft and said polygonal shape of said central opening lock said shaft into a stable position in said grommet after said step of puncturing.

16. The method of claim 14, wherein said spiked fluid dispensing device is located within said overwrap during said transporting.

17. The method of claim 16, wherein said stabilizing grommet is within said overwrap during said transporting.

* * * * *